US006758055B2

(12) United States Patent
Watanabe et al.

(10) Patent No.: US 6,758,055 B2
(45) Date of Patent: Jul. 6, 2004

(54) EXPANSION VALVE AND REFRIGERATION CYCLE

(75) Inventors: Kazuhiko Watanabe, Tokyo (JP); Tomonori Shimura, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 0 days.

(21) Appl. No.: 10/396,405

(22) Filed: Mar. 26, 2003

(65) Prior Publication Data

US 2003/0189104 A1 Oct. 9, 2003

(30) Foreign Application Priority Data

Apr. 8, 2002 (JP) ..... 2002-105005

(51) Int. Cl.[7] ..... F25B 41/04
(52) U.S. Cl. ..... 62/225; 236/92 B; 251/359
(58) Field of Search ..... 62/225; 236/92 B; 251/359, 360, 368

(56) References Cited

U.S. PATENT DOCUMENTS 1,512,243 A * 10/1924 Shrode ..... 137/505.34
2,663,502 A * 12/1953 Dillman ..... 236/92 R
2,967,403 A * 1/1961 Lange et al. ..... 62/196.1
2,971,348 A 2/1961 Orth
6,164,624 A 12/2000 Watanabe et al.
6,209,793 B1 * 4/2001 Taguchi ..... 236/92 B
6,268,830 B1 * 7/2001 Nakagawa et al. ..... 343/702
6,560,982 B2 * 5/2003 Kobayashi et al. ..... 62/225

FOREIGN PATENT DOCUMENTS

EP 0 736 737 A2 10/1996
EP 0 846 927 A1 6/1998
EP 0 959 310 A1 11/1999
JP 08-334280 A2 12/1998

* cited by examiner

*Primary Examiner*—William E. Tapolcai
(74) *Attorney, Agent, or Firm*—Rader, Fishman & Grauer PLLC

(57) ABSTRACT

An orifice member 10 disposed at an orifice 32*a* of a valve body 30 is formed of a material such as stainless steel harder than the aluminum material forming valve body 30. Orifice member 10 is substantially cylindrical, with one open end 10*a* having a flat surface that comes in planar contact with a contact surface of valve body 30 constituting orifice 32*a*, and the other open end being tapered so as to oppose to a valve member 32*d*. A screw portion is formed to the outer side of orifice member 10 enabling it to be engaged to a screw portion formed on orifice 32*a* of valve body 30. The joint can be secured by applying and curing an adhesive between orifice member 10 and orifice 32*a*. Since orifice member 10 comes in planar contact with valve body 30 having an anodized aluminum film, the film is not damaged by orifice member.

2 Claims, 5 Drawing Sheets

EXPANSION VALVE AND REFRIGERATION CYCLE

FIELD OF THE INVENTION

The present invention relates to an expansion valve and a refrigeration cycle for use in an air conditioner of a car, a refrigerating display case, or the like.

DESCRIPTION OF THE RELATED ART

There are various types of expansion valves, and a widely used expansion valve comprises an orifice formed by narrowing a portion of a high-pressure refrigerant path through which high-pressure refrigerant traveling to an evaporator passes, and a valve member disposed upstream of and opposing to the orifice, the valve member moved to open and close the valve in response to the temperature and pressure of a low-pressure refrigerant sent out from the evaporator.

One example of this type of expansion valves is disclosed in Japanese Patent Laid-Open No. 8-334280 regarding an expansion valve used in a refrigeration cycle of an air conditioner of a car.

That is, as illustrated in FIG. 3, a refrigeration cycle 1 comprises a compressor 2 driven by an engine, a condenser 3 connected to the output side of the compressor 2, a liquid tank 4 connected to the condenser, an expansion valve 5 for expanding the liquid-phase refrigerant from the liquid tank 4 into a two-phase refrigerant of vapor and liquid, and an evaporator 6 connected to the expansion valve 5.

The expansion valve 5 comprises an expansion valve body 5*a* provided with a high-pressure-side path 5*b* through which liquid-phase refrigerant travels and a low-pressure-side path 5*c* through which two-phase refrigerant of vapor and liquid travels, wherein the high-pressure-side path 5*b* and the low-pressure-side path 5*c* are communicated via an orifice 7. Further, a valve member 8 that adjusts the amount of refrigerant passing through the orifice 7 is equipped in a valve chamber 8*d*.

In the expansion valve 5, a low-pressure refrigerant path 5*d* is formed to pass through the expansion valve body 5*a*, and in the low-pressure refrigerant path 5*a* is disposed an actuating rod 9*a* in a slidable manner, the actuating rod 9*a* being driven by a power element portion 9 fixed to the upper portion of the expansion valve body 5*a*. The interior space of the power element portion 9 is divided by a diaphragm 9*d* into an upper airtight chamber 9*c* and a lower airtight chamber 9*c*'. A disc portion 9*e* disposed at the upper end of the actuating rod 9*a* comes into contact with the diaphragm 9*d*. In the power element portion 9, an upper lid 9*f* is provided with a tube connecting hole 9*g* formed to the center portion thereof, and a capillary tube 9*h* is mounted to the tube connecting hole 9*g*.

Furthermore, at the lower portion of the expansion valve body 5*a*, a compression coil spring 8*a* pressurizing via a support member 8*c* the valve member 8 toward its valve closing direction is disposed within the valve chamber 8*d*. The valve chamber 8*d* is defined by the expansion valve body 5*a* and an adjustment screw 8*b* screwed onto the expansion valve body 5*a* through the seal of an O-ring 8*e*. An actuating rod 9*b* attached to the lower end of the actuating rod 9*a* moves the valve member 8 toward the valve opening direction by the sliding movement of the actuating rod 9*a*.

The actuating rod 9*a* in the power element portion 9 transmits the temperature of the low-pressure refrigerant path 5*d* to the upper airtight chamber 9*c*, and in correspondence to the transmitted temperature, the pressure within the upper airtight chamber 9*c* changes. For example, if the temperature is high, the pressure within the upper airtight chamber 9*c* rises so that the diaphragm 9*d* pushes down the actuating rod 9*a*, the movement of which drives the valve member 8 in the direction opening the valve. Thus, the amount of refrigerant passing through the orifice 7 increases, and the temperature of the evaporator 6 is thereby reduced.

On the other hand, if the temperature is low, the pressure within the upper airtight chamber 9*c* falls so that the force of the diaphragm 9*d* pushing down the actuating rod 9*a* weakens, and the valve member 8 moves in the direction closing the valve by the force of the compression coil spring 8*a* biasing the member 8 in the valve closing direction. Thus, the amount of refrigerant passing through the orifice 7 decreases, and the temperature of the evaporator 6 is thereby increased.

Thus, the expansion valve 5 moves the valve member 8 according to the change in temperature of the low-pressure refrigerant path 5*d* to thereby change the opening of the orifice 7, adjusting the amount of refrigerant passing through the orifice and thus controlling the temperature of the evaporator 6. Thus, in this type of expansion valve 5, the opening area of the orifice 7 for realizing adiabatic expansion of the liquid-phase refrigerant to two-phase refrigerant is determined by adjusting via the adjustment screw 8*b* the spring load of the compression coil spring 8*a* having a variable spring load that pressurizes the valve member 8 toward the direction closing the valve.

FIG. 3 illustrates an example of the expansion valve 5 wherein a capillary tube 9*h* is mounted on the tube mounting hole 9*g* of the power element portion 9. FIG. 4 illustrates an alternative example comprising a sealing plug 9*i* provided instead of the capillary tube 9*h* on the tube mounting hole 9*g*, an expansion valve body 5*a* having a rectangular column form, a thin portion 5*e* formed at the bottom of both side portions of the body, and bolt holes 5*f* created to the body near the low-pressure refrigerant passage 5*d*.

FIG. 5 is a vertical cross-sectional view showing another prior-art example of the expansion valve illustrated with a refrigerant cycle 1, with the construction of the heat sensing shaft varied from the example shown in FIG. 3. An expansion valve 101 illustrated in FIG. 5 comprises a valve body 30 similar to the valve body of the prior art example illustrated in FIG. 3, having a high-pressure-side path 32*c* through which high-pressure refrigerant flowing toward an evaporator 6 travels, a low-pressure-side path 32*b*, an orifice 32*a* disposed between the paths 32*c* and 32*b*, a spherical valve member 32*d* disposed to oppose to the orifice 32*a* from the upstream side of the refrigerant, a bias means 32*e* for biasing the valve member toward the orifice from the upstream side, a valve component 32*f* disposed between the bias means and the valve member for transmitting the biasing force of the bias means to the valve member 32*d*, a power element portion 36 that operates in connection with the temperature of a low-pressure refrigerant exiting the evaporator 6, and a heat sensing drive rod 318 having a heat sensing rod and an actuating rod integrally formed and disposed between the power element portion and the valve member, wherein the movement of the power element portion 36 drives the valve member 32*d* to move toward or away from the orifice 32*a* to thereby control the flow of refrigerant passing through the orifice.

The power element portion 36 comprises a diaphragm 36*a* made of a metallic thin plate having flexibility such as stainless steel, an upper cover 36*d* and a lower cover 36*h* made of stainless steel constituting an airtight wall sandwiching the diaphragm 36*a* and defining two pressure chambers, an upper pressure chamber 36*b* and a lower pressure chamber 36*c*, divided by the diaphragm 36*a*, and a hole cap 36*i* for filling a refrigerant into the upper pressure chamber 36*b* as a diaphragm driving medium. The lower pressure chamber 36*c* is communicated to a second path 34 via a pressure equalizing hole 36*e* which is formed concentrically with the center line of the orifice 32*a*. A refrigerant vapor exiting the evaporator 6 travels through the second path 34, by which the path 34 functions as a gas-phase refrigerant path, and the pressure of the gas-phase refrigerant is loaded on the lower pressure chamber 36*c* through the pressure equalizing hole 36*e*. The lower cover 36*h* is further equipped with a tube-like mounting seat 362, which is screwed onto the valve body 30 via a screw hole 361.

The heat sensing drive rod 318 has a separately formed upper end portion 36*k*, the heat sensing rod being formed integrally with the actuating rod as a thin rod portion 316 made of stainless steel. The upper end portion 36*k* is a receiver portion constructed of a stopper portion 312 coming into contact with the lower surface of the diaphragm 36*a* and having a rim that is enlarged toward the radial direction, and a large-diameter portion 314 slidably disposed within the lower pressure chamber 36*c* and having on the end opposite from the stopper portion a projection 315 formed to the center thereof. The upper end of the rod 316 is fit to the inner side of the projection 315 formed to the large-diameter portion 314, and the lower end thereof comes into contact with the valve member 32*d*.

The rod member 316 constituting the heat sensing rod is driven to slide freely along with the displacement of the diaphragm 36*a* of the power element portion 36 traversing the path 34, so a clearance (gap) communicating the path 32*c* and the low-pressure refrigerant path 34 is formed along the rod portion 316. In order to prevent communication through this clearance, an O-ring 40 is disposed on the outer periphery of the rod member 316 within a hole 38, so that the O-ring 40 exists between the two paths.

Reference numeral 35 denotes a valve chamber formed coaxially with the orifice 32*a* that communicates with the high-pressure-side path 32*b* and sealed by a plug 39, and further communicates with the high-pressure-side path 32*c* through the orifice 32*a*.

R11 ($CCl_3F$), R12 ($CCl_2F_2$) and other conventional flon-group materials have been used as refrigerants in a refrigerating cycle. However, these materials in which all hydrogen atoms of hydrocarbon radicals have been replaced by chlorine-containing halogen are subjected to a worldwide restraint to stop the destruction of the ozone layer in the stratosphere. To provide alternate flon-group refrigerants that will not destruct the ozone layer, hydrogen-containing halogenated hydrocarbon refrigerants, such as R22 ($CHClF_2$), R123 ($CF_3CHCl_2$), R111b ($CCl_2FCH_3$), R134a ($CF_3CH_2F$), and R152a ($COOF_2CH_3$), have been developed. Especially among them, non-chlorinated halogenated hydrocarbon, such as R134a ($CF_3CH_2F$) and R152a ($CHF_2CH_3$), are considered hopeful.

Non-chlorinated halogenated hydrocarbon, however, is inferior to conventional flon-group refrigerants in respect of lubricity, and often causes metallic powder to mix in the refrigerant. Since the expansion valve, among various elements of a refrigeration cycle, comprises a valve member opening and shutting an orifice, the valve seat of the orifice is subjected to local abrasion or a sort of corrosion called erosion by metallic powder or other particles contained in the refrigerant.

Japanese Patent Laid-Open Publication No. 8-334280 discloses a construction in which a metal material harder than the valve body is fixed to the orifice of a valve body of a prior art expansion valve.

In the above-mentioned prior art construction, in fixing the metal material constituting an orifice member to the orifice of the expansion valve, the orifice member is provided with a tapered projection, enabling an edge-seal process for securing the fixing of the member to position.

However, in case the valve body of the expansion valve as illustrated in FIG. 3 is made of aluminum material and the aluminum valve body is anodized to create an anodized aluminum film, the above-mentioned projection may partially crack the anodized aluminum coating of the valve body, making it impossible for the anodized aluminum coating to maintain its anti-corrosion property.

SUMMARY OF THE INVENTION

The present invention aims at solving the problems of the prior art. The object of the present invention is to provide an expansion valve having an anodizing treatment provided to the valve body, wherein the valve seat of the orifice is free from local abrasion or corrosion such as erosion.

According to the present invention, there is provided an expansion valve comprising: a valve body including a high-pressure-side path, a low-pressure-side path and a valve opening communicating said two paths; a valve member disposed so as to oppose to said valve opening; and a diaphragm for moving said valve member via an actuating rod; wherein said valve body receives an aluminum anodization treatment, and said orifice is equipped with an orifice member harder than the valve body and having a flat contact surface that comes into planar contact with said valve body.

According to this construction, the anodized aluminum film of the valve body of the expansion valve is free from cracks and damages, and thereby the valve seat of the orifice is protected against local abrasion or erosion.

Furthermore, there is provided an expansion valve wherein the orifice member is a substantially cylindrical member, comprising one open end constituting the flat contact surface that comes into planar contact with the valve body, another open end constituting a surface to which is opposed the valve member, and a screw portion formed to an outer side portion thereof by which the orifice member is fixed to the valve body.

According to this construction, the orifice member capable of preventing local abrasion or erosion can be fixed easily to the valve seat without damaging the anodized aluminum film of the valve body.

There is also provided an expansion valve having an adhesive applied to the screw portion.

Thus, the orifice member can be fixed to the valve seat securely for a long period of time.

Furthermore, there is provided a refrigeration cycle comprising a compressor, a condenser for condensing a gaseous refrigerant heated and compressed by the compressor, a liquid tank for separating the condensed refrigerant into vapor and liquid and for removing moisture and dust from the refrigerant, an expansion valve for expanding the refrigerant from the liquid tank, and an evaporator for realizing heat-exchange between the refrigerant and air, the components all connected by a piping; wherein the refrigerant is non-chlorinated halogenated hydrocarbon, and the expansion valve is any of the expansion valves constructed as explained above.

According to this system, even if the refrigeration cycle utilizes non-chlorinated halogenated hydrocarbon as refrigerant, the anodized aluminum film of the expansion valve is free from cracks, the valve seat of the expansion valve is protected against local abrasion or erosion, and thus a refrigeration cycle capable of operating stably for a long period of time is provided.

DETAILED DESCRIPTION OF THE PREFERRED EMBODIMENT

Now, the preferred embodiment of an expansion valve 101' according to the present invention will be explained in detail with reference to the drawings.

Figure 1:
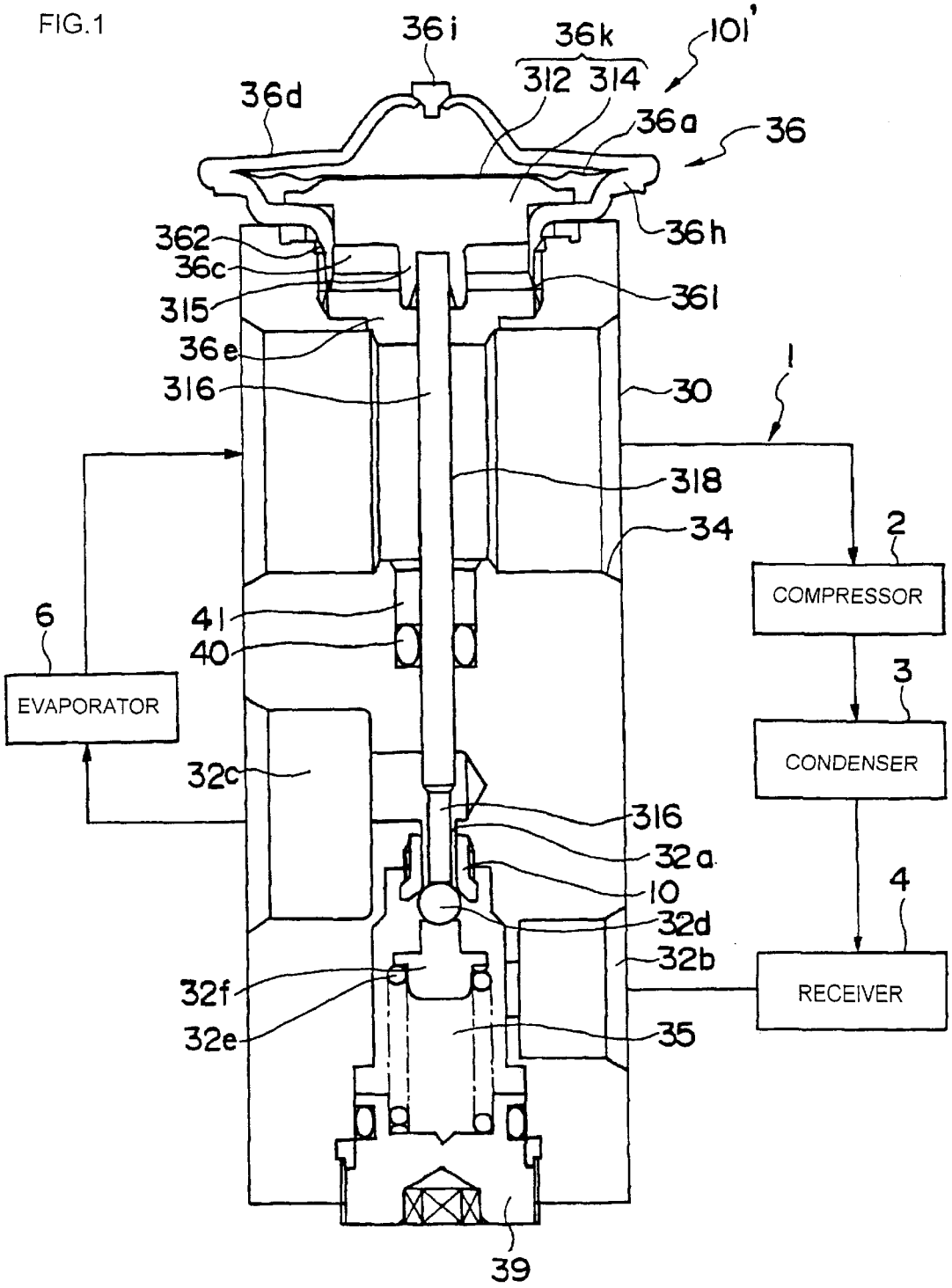
FIG. 1 is a vertical cross-sectional view showing a preferred embodiment of an expansion valve according to the present invention.
Figure 2:
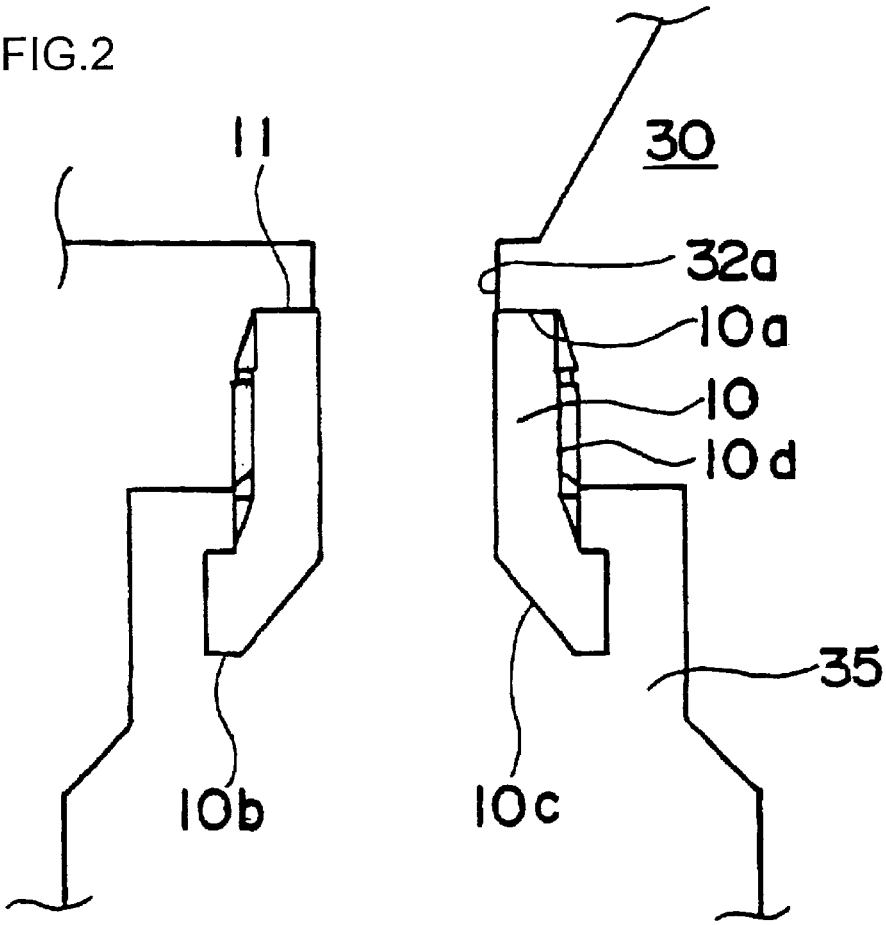
FIG. 2 is a partial enlarged view of FIG. 1.
Figure 3:
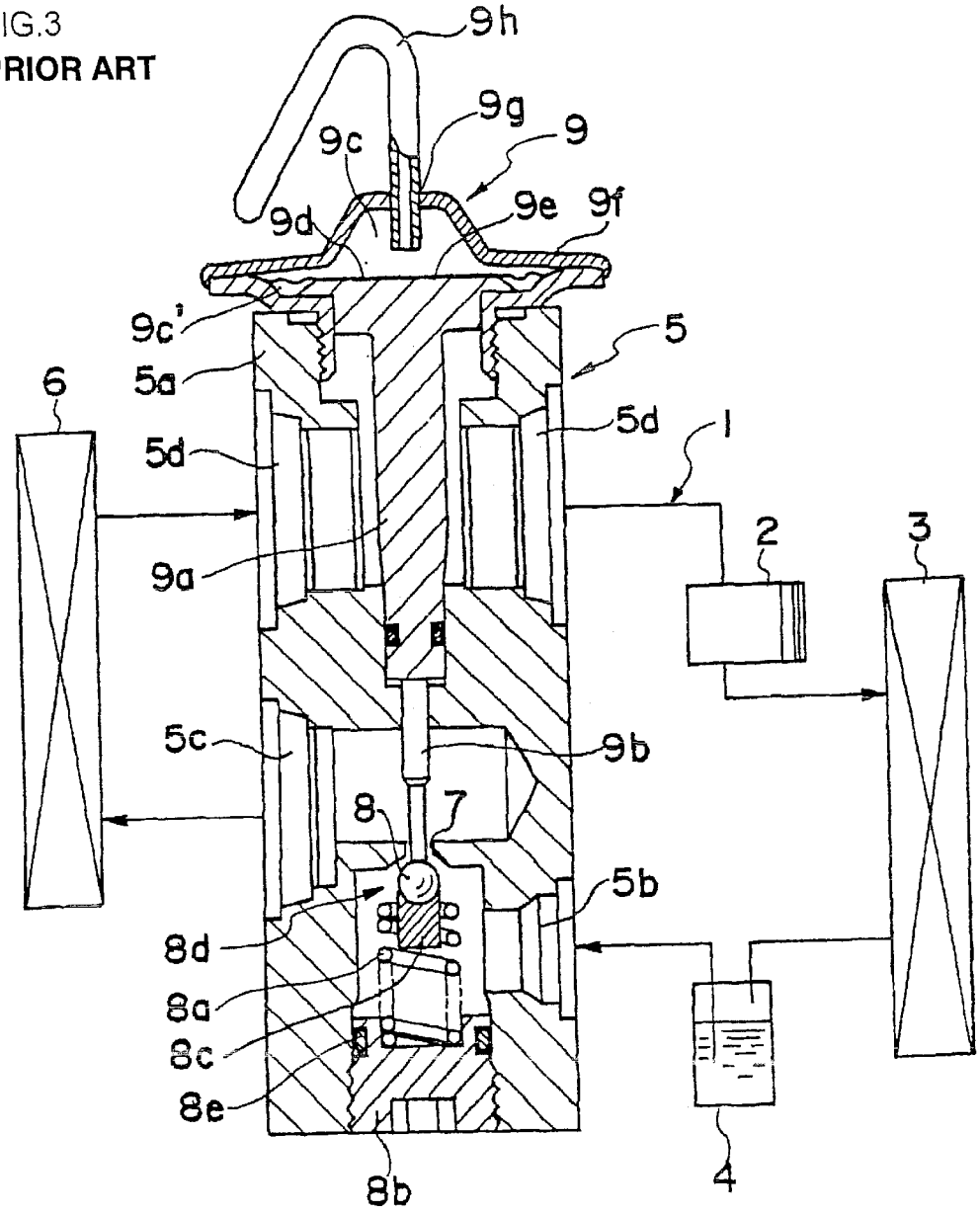
FIG.3 PRIOR ART
FIG. 3 is a vertical cross-sectional view showing an expansion valve according to the prior art.
Figure 4:
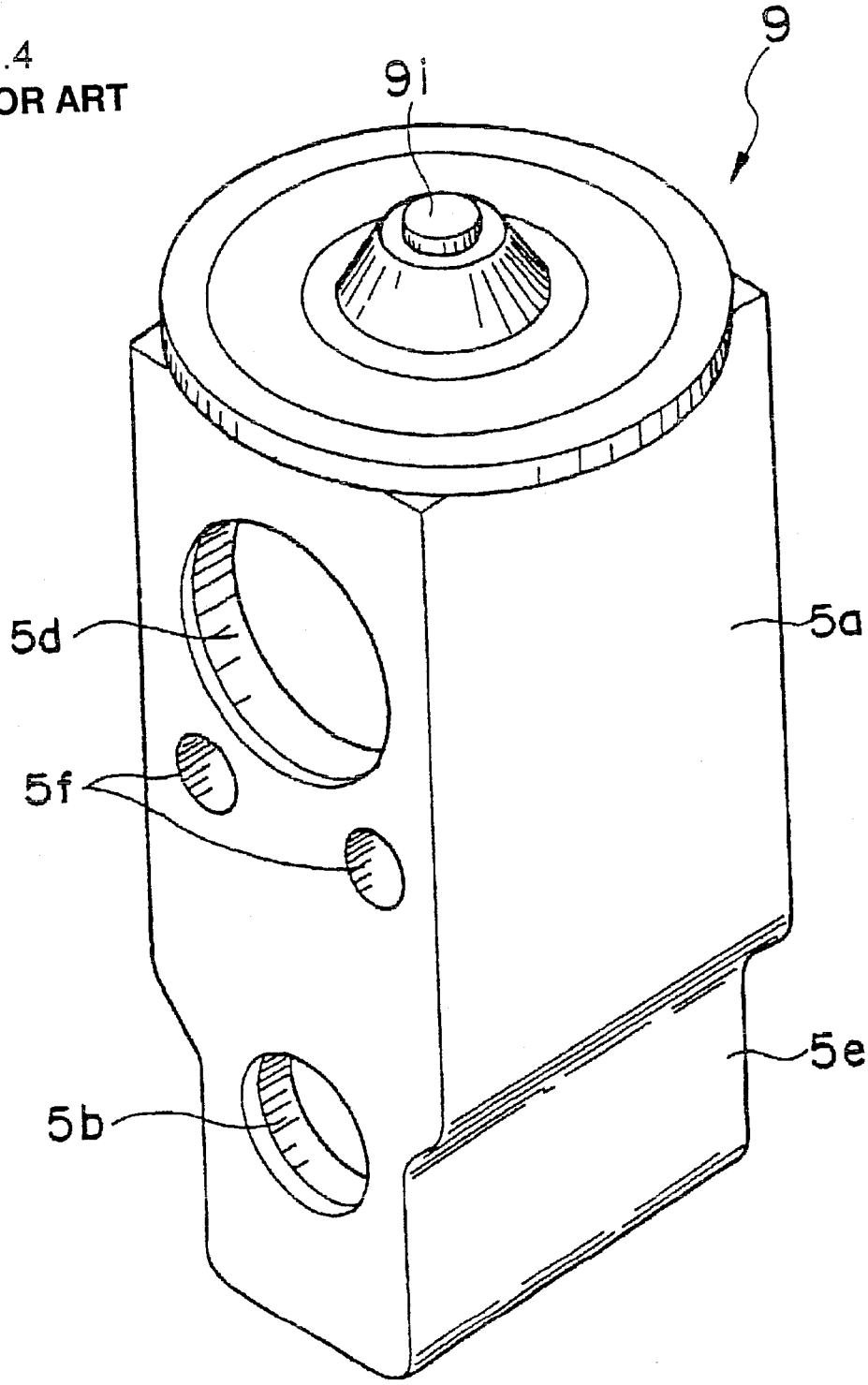
FIG.4 PRIOR ART
FIG. 4 is a view showing the valve body of the expansion valve of FIG. 3.
Figure 5:
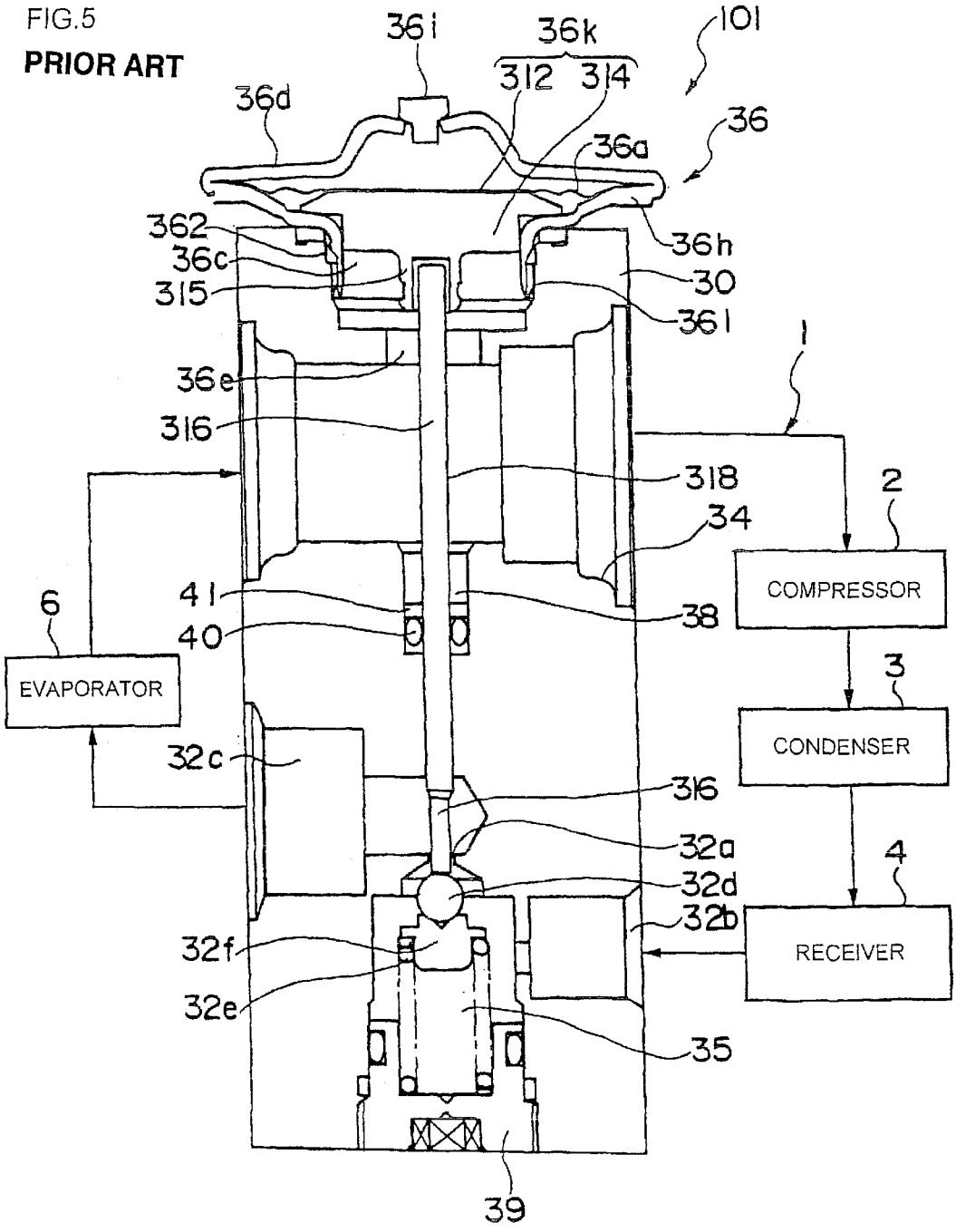
FIG.5 PRIOR ART
FIG. 5 is a vertical cross-sectional view showing another example of an expansion valve according to the prior art.

FIG. 1 is a vertical cross-sectional view of an expansion valve 101' according to one preferred embodiment of the present invention, and FIG. 2 is a partial enlarged view thereof. The illustrated expansion valve is used in a refrigeration cycle of an air conditioner of a car and the like, and has a basic construction similar to the expansion valves illustrated in FIGS. 3 and 5. The only difference from the expansion valves of FIGS. 3 and 5 is that the expansion valve of FIG. 1 comprises an orifice member, so the components of FIG. 1 equivalent to those illustrated in FIG. 5 are provided with the same reference numerals, and the detailed descriptions thereof are omitted.

According to FIGS. 1 and 2, numeral 10 denotes an orifice member disposed to an orifice 32*a* of a valve body 30, which is formed of a material harder than the aluminum material constituting the valve body 30. The orifice member 10 has a substantially cylindrical shape, with one opening end 10*a* formed to have a flat surface so as to come in planar contact with a contact surface 11 of the valve body 30 constituting the orifice 32*a*, and the other opening end 10*b* formed to have an open-V-shaped tapered form 10*c* allowing it to be opposed to the valve member 30.

A screw portion is formed on an outer side portion 10*d* of the orifice member 10, allowing the member to be fixed through screw engagement to a screw portion formed to the orifice 32*a* of the valve body 30. To secure this engagement, an adhesive such as a Loctite (trademark) can be applied to the screw engagement portion between the orifice member 10 and the orifice 32*a* and cured.

By applying the orifice member 10 having the above-mentioned construction to the valve body 30 provided with aluminum anodization treatment, since the orifice member 10 is fixed to the valve body 30 via a flat contact surface, the orifice member 10 will not cause the anodized aluminum film of the valve body 30 to be locally cracked and damaged.

Furthermore, the orifice member 10 can be fixed to the orifice 32*a* through a simple screw engagement, and the fixture can be secured firmly for a long period of time by applying an adhesive to the screw engagement portion.

Moreover, when the expansion valve 101' according to the present embodiment shown in FIG. 1 is applied to a refrigeration cycle utilizing a refrigerant of a non-chlorinated halogenated hydrocarbon, the local abrasion or erosion of the valve seat is prevented, and a refrigeration cycle that operates stably for a long period of time is achieved.

According to the present embodiment illustrated in FIG. 1, explanation on the components of the refrigeration cycle such as the compressor, the condenser, the receiver and the evaporator, and the explanation on the action of the expansion valve 101' are omitted, since they are the same as the expansion valves of FIGS. 3 and 5.

As explained above, the expansion valve according to the present invention comprising a valve body with an anodized aluminum film is equipped with an orifice member made of a material harder than the valve body fixed to the orifice via a flat contact surface, the construction preventing the anodized aluminum film from being damaged, and realizing an expansion valve having superior durability.

By using such an expansion valve, a refrigeration cycle that operates stably for a long time can be provided.

What is claimed is:

1. An expansion valve comprising:

a valve body including a high-pressure-side path, a low-pressure-side path and an orifice communicating said two paths; a valve member disposed so as to oppose to said orifice; and a diaphragm for moving said valve member via an actuating rod;

wherein said valve body receives an aluminum anodization treatment, and said orifice is equipped with an orifice member affixed therein, said orifice member being harder than the valve body and having a flat contact surface that comes into planar contact with said valve body, said orifice member is a substantially cylindrical member and includes one open end constituting the flat contact surface that comes into planar contact with the valve body, another open end including a flange portion extending radially from the cylindrical member and defining a frustoconically-shaped valve opening and constituting a surface to which is opposed said valve member, and a screw portion formed to an outer side portion of said orifice member by which said orifice member is fixed to said valve body and an adhesive is applied to said screw portion with said flange portion being disposed apart from the orifice in a non-contacting relationship with said valve body when the orifice member is fixed in the orifice to said valve body.

2. A refrigeration cycle comprising:

a compressor, a condenser for condensing a gaseous refrigerant heated and compressed by the compressor, a liquid tank for separating the condensed refrigerant into vapor and liquid and for removing moisture and dust from the refrigerant, an expansion valve for expanding the refrigerant from the liquid tank, and an evaporator for realizing heat-exchange between the refrigerant and air, the components all connected by a piping;

wherein said refrigerant is a non-chlorinated halogenated hydrocarbon, and said expansion valve is the expansion valve according to claim 1.

* * * * *